US007020929B1

(12) United States Patent
Cantonis

(10) Patent No.: US 7,020,929 B1
(45) Date of Patent: Apr. 4, 2006

(54) ELONGATED CHAMOIS PAD

(75) Inventor: James M. Cantonis, Belleair, FL (US)

(73) Assignee: Acme Sponge and Chamois Co., Inc., Tarpon Springs, FL (US)

( * ) Notice: Subject to any disclaimer, the term of this patent is extended or adjusted under 35 U.S.C. 154(b) by 893 days.

(21) Appl. No.: 09/715,073

(22) Filed: Nov. 20, 2000

Related U.S. Application Data

(60) Provisional application No. 60/166,424, filed on Nov. 19, 1999.

(51) Int. Cl.
*A47L 13/16* (2006.01)

(52) U.S. Cl. ..... 15/209.1; 15/210.1

(58) Field of Classification Search ..... 15/209.1, 15/210.1
See application file for complete search history.

(56) References Cited

U.S. PATENT DOCUMENTS

| | | | | | |
|---|---|---|---|---|---|
| 108,144 | A | | 10/1870 | Hull | |
| 2,526,076 | A | * | 10/1950 | Jones | 15/209.1 |
| 3,083,392 | A | * | 4/1963 | Sewell | 15/118 |
| 3,206,784 | A | * | 9/1965 | Linenfelser | 15/118 |
| 3,377,643 | A | | 4/1968 | Teng et al. | |
| 4,015,306 | A | | 4/1977 | Fenster | |
| D262,432 | S | | 12/1981 | Lambert | |
| 4,670,962 | A | | 6/1987 | Giallourakis | |
| 4,769,267 | A | | 9/1988 | Hoyt | |
| 4,821,360 | A | | 4/1989 | Giallourakis | |
| D307,497 | S | | 4/1990 | Giallourakis | |
| 5,177,831 | A | | 1/1993 | Wirth | |
| 5,671,498 | A | * | 9/1997 | Martin et al. | 15/244.3 |
| 5,918,341 | A | * | 7/1999 | Hale | 15/209.1 |

* cited by examiner

*Primary Examiner*—John Kim
*Assistant Examiner*—Laura C Guidotti
(74) *Attorney, Agent, or Firm*—James Creighton Wray; Meera P. Narasimhan

(57) ABSTRACT

An elongated wringable chamois pad is used for washing, rinsing and wiping large surface areas. A poly sponge measuring about sixteen and one-half inches long by about four inches wide by about two inches high is tightly enclosed within a chamois covering with die cut holes. The elongated chamois covering is first formed by stitching together two pairs of smaller rectangular pieces of chamois. The resulting elongated sheets of each pair of chamois is stitched together with the other pair on two or three sides then turned inside out forming a pocket with smooth outward seams on the two parallel long edges, one end edge and around the circumference in the center of the invention between the two opposing short ends. The elongated sponge is slightly compressed and is forced into the pocket. Finally, the last short end of the chamois covering is stitched.

56 Claims, 3 Drawing Sheets

ELONGATED CHAMOIS PAD

This application claims the benefit of U.S. Provisional Application No. 60/166,424 filed Nov. 19, 1999.

BACKGROUND OF THE INVENTION

Existing chamois covered sponges are inadequate for the purposes of washing, rinsing and wiping large surface areas and then wringing the chamois covered sponge dry.

Needs exist for more efficient chamois covered sponges which are easier for the user to wring out and which wash, rinse and wipe large surface areas in less time.

SUMMARY OF THE INVENTION

The present invention improves upon currently available chamois covered cleaning devices. The invention provides an elongated poly sponge uniquely covered by a chamois which is uniformly punctured with die cut holes.

The long chamois covered sponges may be wrung out like a rag. More water can be held within the elongated sponge in comparison to currently available sponges. When wrung out, more of the water is forced through the chamois covering to clean the covering. The elongated chamois covered sponge makes quick work out of washing, rinsing and wiping large areas. The wringing out presents clean renewed chamois facings.

In a preferred chamois pad, the smooth seams on the edges of the pad and around the circumference are created by sewing two pairs of smaller rectangular pieces of chamois together. The resulting two long chamois rectangles are sewn together along two side edges and one end edge or along two end edges and th side edges. Turning the chamois inside out faces the stitching inward toward the long poly sponge as it is loaded in the chamois pocket. The fourth edge, which is the second end edge, is tightly bound with stitching facing outwardly from the device. The chamois forms a tight skin-like covering for the sponge so that it does not shift during repeated use.

Preferably the cover pieces of the invention are made by sewing together four smaller rectangular pieces of chamois with die cut holes which are aligned in alternating rows.

Distinct advantages arise in the present invention from its long dimension. Currently available chamois covered sponges are hand sized, measuring approximately seven inches in length and four inches in width. The present invention is wringable for forcing clean water through the chamois. The present invention washes, rinses and wipes a much larger area in a single stroke because of its advantage in length.

The preferred elongated chamois pad is approximately two and one third times longer than currently available pads. For example, the pad preferably measures approximately sixteen and one-half inches in length. Users of the new elongated chamois pad experience less strain on their wrists and forearms, because the longer pad is easier to wring out than currently available short pads. Another advantage to the user of the elongated chamois is that almost all of the water can be wrung out of the elongated chamois pad. Therefore, the poly sponge contained within the chamois is able to absorb more clean water for rinsing. The object being cleaned rinses more thoroughly in less time leaving less residue.

These and further and other objects and features of the invention are apparent in the disclosure, which includes the above and ongoing written specification, with the claims and the drawings.

DETAILED DESCRIPTION OF THE PREFERRED EMBODIMENTS

Figure 1:
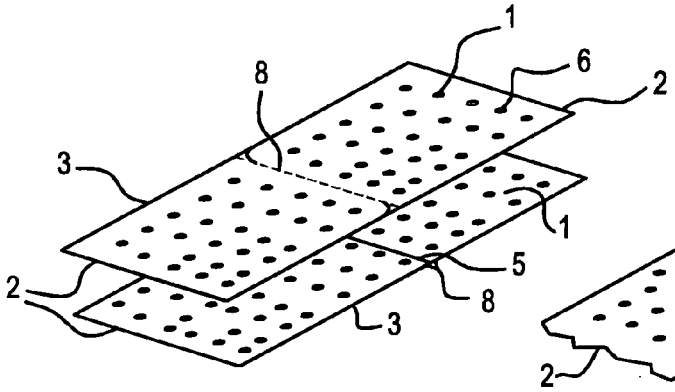
FIG. 1 is a perspective view of two pieces of elongated chamois cover with seams.

In a preferred embodiment of the present invention four small rectangular pieces of chamois each being about nine and one-half inches in length and about six and one-quarter inches wide have die cut or punched holes 6 shown spaced on one-half inch centers as represented in FIG. 1. The four pieces of chamois are stitched together to form a pair of elongated pieces of chamois with outward facing seams 8 in the center of the resulting elongated sheet of chamois 1.

The preferred embodiment uses chamois made from sheep-skin. The smaller pieces are more plentiful and less expensive than much larger pieces. Preferably sheep-skin chamois is used for the cover. Alternatively, man-made chamois-like cloth may be used as a covering.

In a preferred embodiment of the present invention four small rectangular pieces of chamois each being about nine and one-half inches in length and about six and one-quarter inches wide have die cut or punched holes 6 shown spaced on one-half inch centers as represented in FIG. 1. The four pieces of chamois are stitched together to form a pair of elongated pieces of chamois with outward facing seamed edges 8 in the center of the resulting elongated sheet of chamois 1.

Figure 2:
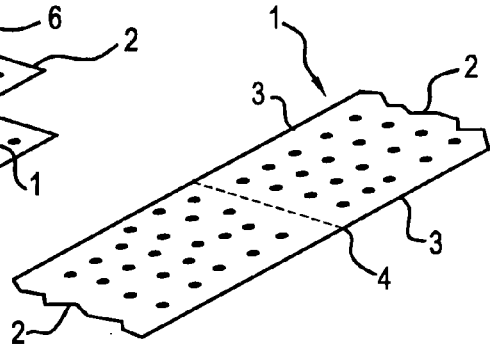
FIG. 2 is a perspective view of a single large rectangular piece of chamois prior to folding and stitching.

In the preferred embodiment shown in FIG. 2, the cover is a single large rectangular piece of chamois 1, which preferably measures about thirty seven and three-quarter inches in length and about six and one-quarter inches in width. The rectangular sheet in FIG. 2 has opposite ends 2 and sides 3. By folding the rectangular sheet end to end about a center 4, the rectangular sheet is transformed into a pocket made of a single rectangular sheet having two equal halves joined together along the fold axis and stitched 7 together along the side edges 3.

Figure 3:
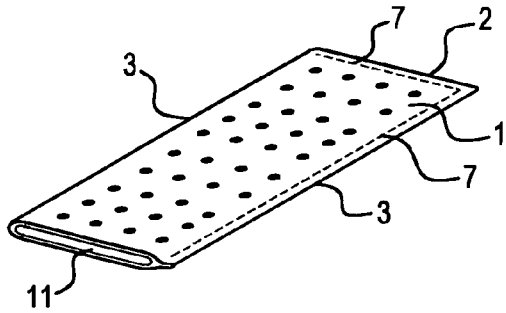
FIG. 3 is a perspective view of a single large rectangular piece of chamois folded in half lengthwise and stitched on one side and one end.

In FIG. 3 a large piece of chamois 1 having a length of about eighteen and three-quarter inches and a width of about twelve and one-half inches is folded in half medially along one side and stitched 7 closed on the opposing long side edge 3 and one end 2, forming a pocket 11 in which to insert the elongated poly sponge.

Figure 4:
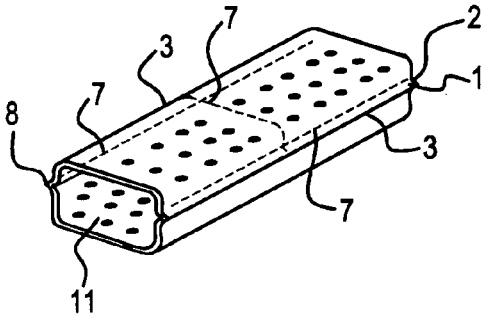
FIG. 4 is a perspective view of the two elongated pieces of chamois of FIG. 1 laid one on top of the other and stitched together on the edges of the two long sides and the edge of one end.

Referring now to FIG. 4, the rectangular pieces of chamois 1 of FIG. 1 are placed one on top of the other so that the side edges 3 and end edges 2 line up and the seamed edges 8 from joining the two smaller rectangular pieces of chamois faces outwardly.

Figure 5:
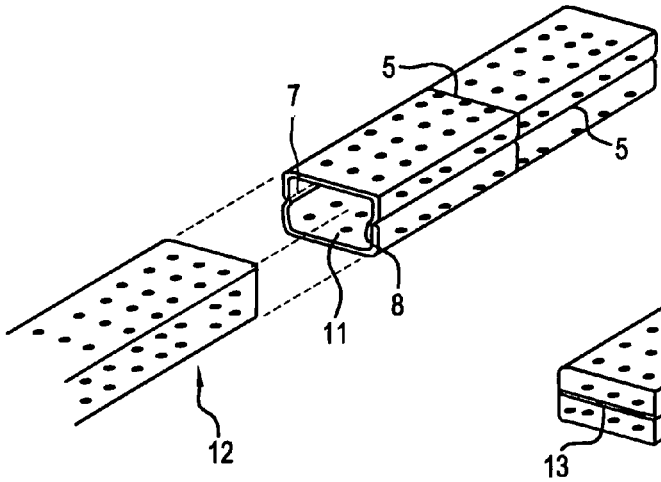
FIG. 5 is a perspective view of the chamois covering and the poly sponge prior to inserting the sponge into the outer covering.

The two longer parallel edges 3 are stitched 7 and one end edge 2 is stitched 7, forming a pocket 11. The pocket is then preferably turned inside out so that the outward facing seamed edges 7 from FIG. 4 is inside the pocket as shown in FIG. 5. However, the invention is not limited this joining of the edges. Other joints, such as along the shorter edges first and then the longer edges and the like, are within the scope of this invention.

Also shown in FIG. 5, the long poly sponge 12 is inserted into the pocket 11. The seamed edges 8 having been turned toward the inside of the pocket leaves smooth seams 5 on the outside surfaces of the invention.

Figure 6:
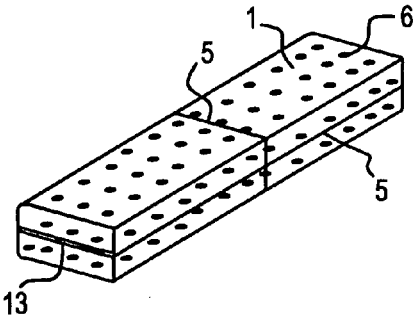
FIG. 6 is a perspective view of the assembled chamois covered sponge showing the smooth seam along the circumference of the center and along one side of the invention and the outward facing stitching on one end.

FIG. 6 shows the finished product with an outer surface of chamois 1 with die cut or punched holes 6 and smooth seams 5. It is understood that the chamois completely covers the poly sponge material and that the remaining end of the rectangular pocket 11 from FIG. 5 is a stitched shut end 13 to prevent the sponge from slipping out of the chamois pocket.

Figure 7:
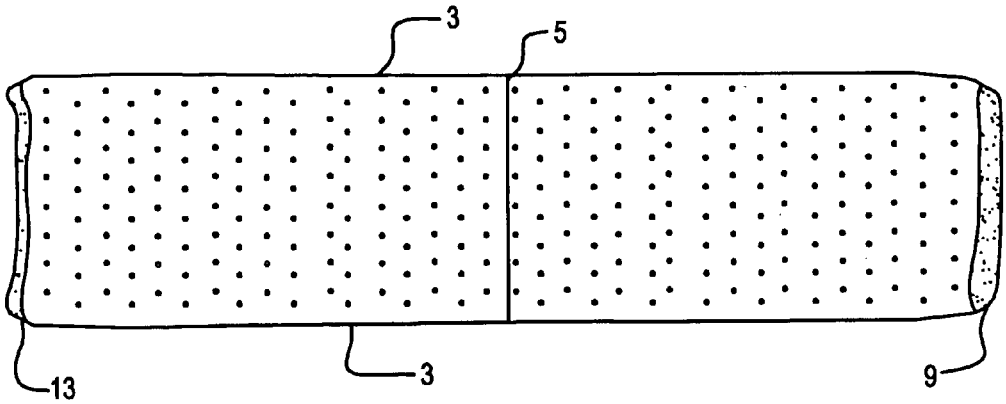
FIG. 7 is a view of the top or bottom surface of the invention.

FIG. 7 is a view of the top or bottom surface of the new elongated wringable chamois pad. This view shows the outwardly stitched shut end 13 and the edges 3 and end 9 and seam 5 which stitching faces toward the inside of the pocket, creating smooth surfaces at the seams where the chamois pieces are joined.

Figure 8:
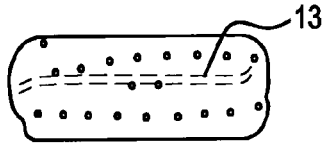
FIG. 8 is a view of the outwardly stitched end of the invention.

FIG. 8 is a view of the new chamois pad showing the outwardly stitched shut end 13.

Figure 9:
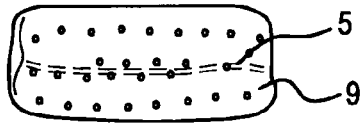
FIG. 9 is a view of the inwardly stitched end of the invention.

FIG. 9 is a view of the new chamois pad showing the smooth seam 5 on end 9 created by the inwardly facing stitching.

Figure 10:
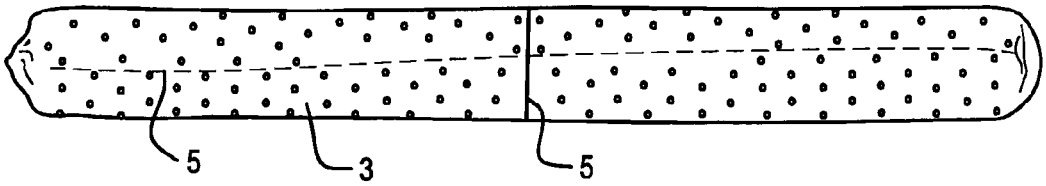
FIG. 10 is a side view of the invention.

FIG. 10 is a side view of either side of the new chamois pad showing the wringable elongation and the smooth seam 5 on side edge 3 and perpendicularly in the middle of this view of the invention created by the inwardly facing stitching.

While the invention has been described with reference to specific embodiments, modifications and variations of the invention may be constructed without departing from the scope of the invention, which is defined in the following claims.

I claim:

1. An elongated wringable pad comprising a cover and an absorbent material in the cover, at least one rectangular piece forming the cover, plural holes in the piece, the pad having a length at least three times greater than a width of the pad to wring-out contents of the pad by twisting along the length of the pad, wherein the cover is a pocket having inward facing joints and smooth outer surfaces, and wherein the cover completely covers the absorbent material and edges of the at least one piece are joined together to prevent the absorbent material from slipping out of the pocket.

2. The pad of claim 1, wherein the holes are die-cut holes.

3. The pad of claim 1, wherein the holes are punched holes.

4. The pad of claim 1, wherein the absorbent material is an elongated poly sponge.

5. The pad of claim 1, wherein the at least one piece is at least one rectangular sheet.

6. The pad of claim 5, wherein the at least one rectangular sheet has opposite end-edges and side-edges.

7. The pad of claim 6, further comprising a pocket formed by joints along the side-edges and/or end-edges of the at least one rectangular sheet for receiving and holding the absorbent material in the pocket.

8. The pad of claim 7, wherein the joints are seams formed by stitches.

9. The pad of claim 8, wherein the pocket has the seams inward facing and smooth outer surfaces.

10. The pad of claim 6, wherein the at least one rectangular sheet has a fold between the end-edges about an axis forming a pocket having equal halves joined together along the side-edges.

11. The pad of claim 6, wherein the at least one rectangular sheet has a fold between the side-edges about an axis forming a pocket having equal halves joined together along the end-edges.

12. The pad of claim 6, wherein the at least one rectangular sheet has a fold medially along one side-edge and one end-edge forming a pocket having the opposite side-edges joined to each other.

13. The pad of claim 6, wherein the at least one rectangular sheet has a fold medially along one end-edge forming a pocket having the opposite side-edges joined together.

14. The pad of claim 5, wherein a length of the cover is about thirty seven and three-quarter inches and a width is about six and one-quarter inches.

15. The pad of claim 5, wherein a length of the cover is about eighteen and three-quarter inches and a width is about twelve and one-half inches.

16. The pad of claim 1, wherein the at least one piece is a chamois piece.

17. The pad of claim 1, further comprising plural pieces forming the cover.

18. An elongated wringable pad comprising a cover and an absorbent material in the cover, at least one rectangular piece forming the cover, plural holes in the piece, the pad having a length at least three times greater than a width of the pad to wring-out contents of the pad by twisting along the length of the pad, wherein the holes are spaced on one-half inch centers of the cover.

19. An elongated wringable pad comprising a cover and an absorbent material in the cover, at least one rectangular piece forming the cover, plural holes in the piece, the pad having a length at least three times greater than a width of the pad to wring-out contents of the pad by twisting along the length of the pad, further comprising plural pieces forming the cover, wherein the plural pieces are chamois pieces.

20. The pad of claim 19, wherein the chamois is sheepskin chamois.

21. The pad of claim 19, wherein the plural pieces are of man-made chamois cloth material.

22. The pad of claim 19, wherein the plural pieces are at least four pieces forming the cover.

23. The pad of claim 22, wherein the pieces are rectangular pieces.

24. The pad of claim 23, wherein each piece is about nine and one-half inches in length.

25. The pad of claim 23, wherein each piece is about six and one-quarter inches wide.

26. The pad of claim 23, further comprising connections for connecting the four pieces.

27. The pad of claim 26, wherein the connections are stitched seams.

28. The pad of claim 27, wherein the seams are formed along side-edges and end-edges of the at least four rectangular pieces positioned as paired-pieces placed on top of one another for alignment of the side-edges and end-edges for receiving stitches to join each of a pair of two smaller rectangular pieces to the other.

29. The pad of claim 27, wherein the seams are formed along two longer parallel side-edges and one end-edge.

30. The pad of claim 29, further comprising a pocket formed by the stitched seams.

31. The pad of claim 30, wherein the pocket has the connections facing inwards and smooth outer surfaces after turning the pocket inside-out.

32. The pad of claim 31, wherein the absorbent material is an elongated poly sponge inserted into the pocket.

33. The pad of claim 27, wherein the at least four pieces with the seams form a pair of elongated pieces of chamois with outward facing seams, said seams being in a center of an elongated sheet of chamois formed by the connections of the four pieces together prior to insertion of the absorbent material.

34. The pad of claim 33, further comprising a pocket formed when the at least four pieces joined by the seams are turned inside-out, and wherein the pocket has the seams facing inwards and smooth outer surfaces.

35. An elongated wringable pad comprising a cover and an absorbent material in the cover, at least one rectangular piece forming the cover, plural holes in the piece, the pad having a length at least three times greater than a width of the pad to wring-out contents of the pad by twisting along the length of the pad, further comprising plural pieces forming the cover, wherein the plural pieces are at least four nieces forming the cover, wherein the pieces are rectangular pieces, and wherein the pieces are of chamois material.

36. The pad of claim 35, wherein the cover is a pocket having inward facing joints and smooth outer surfaces.

37. The pad of claim 36, wherein at least one of the edges joined together has outward facing seams.

38. An elongated wringable pad comprising an absorbent material, a cover enclosing the absorbent material, the cover comprising first and second elongated opposite side portions disposed between top and bottom elongated portions, and first and second opposite end portions disposed between the top and bottom elongated portions and between the first and second elongated side portions, the absorbent material having a complementary shape for fitting within the cover, and the cover having a plurality of openings for wringing-out contents of the pad by twisting along the length of the pad, wherein a length of the pad is at least three times greater than a width of the pad.

39. The pad of claim 38, wherein the plurality of openings are disposed in the top portion of the cover.

40. The pad of claim 38, wherein the plurality of openings are disposed in the bottom portion of the cover.

41. The pad of claim 38, wherein the plurality of openings are disposed in the first side portion of the cover.

42. The pad of claim 38, wherein the plurality of openings are disposed in the second side portion of the cover.

43. The pad of claim 38, wherein the plurality of openings are disposed in the first and second elongated side portions of the cover.

44. The pad of claim 38, wherein the plurality of openings are disposed in the top and bottom elongated portions of the cover.

45. The pad of claim 38, wherein the plurality of openings are disposed in the first and second opposite end portions.

46. The pad of claim 38, wherein the plurality of openings are disposed in the portions of the cover selected from the group consisting of the top elongated portion, the bottom elongated portion, the first elongated side portion, the second elongated side portion, the first end portion, the second end portion, and combinations thereof.

47. The pad of claim 38, wherein the cover further comprises connections.

48. The pad of claim 47, wherein the connections are seams having seam edges on the cover turned inwards towards the absorbent material and having smooth outer surfaces on all the portions of the cover.

49. The pad of claim 48, wherein the connections are on the first elongated side portion.

50. The pad of claim 48, wherein the connections are on the second elongated side portion.

51. The pad of claim 48, wherein the connections are on the first end portion.

52. The pad of claim 48, wherein the connections are on the second end portion.

53. The pad of claim 48, wherein the connections are on the top elongated portion.

54. The pad of claim 48, wherein the connections are on the bottom elongated portion.

55. The pad of claim 48, wherein the connections are disposed on the portions of the cover selected from the group consisting of the top elongated portion, the bottom elongated portion, the first elongated side portion, the second elongated side portion, the first end portion, the second end portion, and combinations thereof.

56. The pad of claim 38, wherein lengths of the first and second elongated side portions and of the top and bottom portions are at least three times greater than widths of the first and second end portions.

* * * * *